United States Patent [19]

Jakel

[11] 4,017,230

[45] Apr. 12, 1977

[54] MEANS FOR FORMING TAPERED SLABS

[75] Inventor: Gus R. Jakel, Glendale, Calif.

[73] Assignee: California Cement Shake Co., Inc., Irwindale, Calif.

[22] Filed: July 25, 1975

[21] Appl. No.: 598,765

Related U.S. Application Data

[60] Continuation-in-part of Ser. No. 443,137, Feb. 14, 1974, abandoned, which is a division of Ser. No. 303,225, Nov. 2, 1972, Pat. No. 3,870,777.

[52] U.S. Cl. ..... 425/84; 425/356; 425/362; 425/432; 425/454

[51] Int. Cl.[2] ..... B28B 1/08; B28B 3/12

[58] Field of Search ..... 425/84, 356, 362, 360, 425/363, 373, 432, 434, 453–454, 456, 417, 405 H; 249/65

[56] References Cited

UNITED STATES PATENTS

| | | | |
|---|---|---|---|
| 991,412 | 5/1911 | Baade | 425/356 |
| 1,001,952 | 8/1911 | Henley | 425/453 |
| 1,064,718 | 6/1913 | Ellendt | 425/432 |
| 1,281,577 | 10/1918 | Jagenburg | 425/84 |
| 1,304,185 | 5/1919 | Jordan | 425/454 |
| 2,101,528 | 12/1937 | Bjorklund | 425/84 |
| 2,149,029 | 2/1939 | Mickelson et al. | 425/434 |
| 2,719,346 | 10/1955 | Caciagli | 425/456 |
| 3,050,115 | 8/1962 | Leitzel | 249/65 |
| 3,257,701 | 6/1966 | Lang | 425/432 |

*Primary Examiner*—Robert L. Spicer, Jr.
*Assistant Examiner*—John McQuade
*Attorney, Agent, or Firm*—William W. Haefliger

[57] ABSTRACT

A cementitious product slab useful in construction is made by:

a. preparing a flowable aqueous cemetitious slurry,
b. forming a selected quantity of the slurry into slab shape, said forming step including vibrating said slurry quantity to aid slab shape formation,
c. pressurizing the formed slab to squeeze water therefrom, and
d. curing the resultant slab.

9 Claims, 21 Drawing Figures

PRODUCT 31
AIR DRY
CURE
PRESSURIZATION & WATER REMOVAL
30
MOLD
VIBRATION
37
38
39
29
40a
40b
40c
35
36
PERLITE
DAREX
CEMENT
COLORANT
12
27
11
70
MIXER
10
13
16
23
CARDBOARD
GLASS FIBER
14
15
BLEND
17
$H_2O$
19
TALLOW
22
18
$H_2O$
21
SLAKE
QUICK LIME
20
$H_2O$
26
25
MIXER
ACCELERATOR
24
44
44a
44b
62
37
43
43a
43b
51
51a
31
50
52
53
60
3
3

PULPER
SLAKE
MIXER
WEIGH HOPPER
WEIGH HOPPER
BLENDER
AUTOMATED CONTROL
HOLD MIX
FILL & VIBRATE
PRESSURE WATER REMOVAL
REMOVE
CURE
PACKAGE
CONTROL
CONTROL
CONTROL
CEMENT
PERLITE
DAREX
FIBER
PAPER
BX
QUICK LIME
TALLOW
ACCELERATOR
COLORANT

MEANS FOR FORMING TAPERED SLABS

BACKGROUND OF THE INVENTION

This application is a continuation-in-part of my prior application Ser. No. 443,137 filed Feb. 14, 1974, now abandoned which was a division of Ser. No. 303,225 filed Nov. 2, 1972 now U.S. Pat. No. 3,870,777.

This invention relates generally to the production of lightweight, fireproof roofing and siding as used in contruction, and more particularly concerns apparatus used in such production.

There is a continuing need for products as referred to which have the following characteristics: relatively lightweight, fireproof, waterproof, nailable, insulative and relatively inexpensive. For example, there is need for fireproof, cementitious shake roofing which will not impose loads greater than 700 pounds per 100 square feet of roof area, to meet standard construction codes. Insofar as we are aware, there is no known product embodying all of the above characteristics, and which can be made by the unusually advantageous apparatus to be described herein.

SUMMARY OF THE INVENTION

It is a major object of the invention to provide apparatus to produce cementitious product slabs, as for example shingles or shakes, and incorporating means to produce a flowable aqueous cementitious slurry; means to receive a selected quantity of the slurry, to form same into slab shape and to vibrate the formed slab; means to pressurize a sequence of the formed slabs to squeeze water from them, and means to cure the resultant slabs. As will be seen, the forming of the slabs is carried out while maintaining their upper faces free to assume generally horizontally flat configuration, and structure is provided to support the slabs in such manner as to allow drainage of water during pressurization. Also, where shakes are to be produced, that structure supports the slab undersides with inclination relative to horizontal so that the shakes are tapered.

The pressurization apparatus may advantageously include a flexible mold imparting to the slab upper surface a striated configuration, as will be seen, the mold configured to progressively peel off the slab or shake to facilitate mold separation. Such pressurization is typically carried out while the slab or slabs are transported, and the slab undersides may be supported at multiple closely spaced locations to pass freed water downwardly. The resultant product slabs may be cured in kiln and air drying apparatus to be described.

These and other objects and advantages of the invention, as well as the details of an illustrative embodiment, will be more fully understood from the following description and drawings, in which:

DRAWING DESCRIPTION

DETAILED DESCRIPTION

Figure 9:
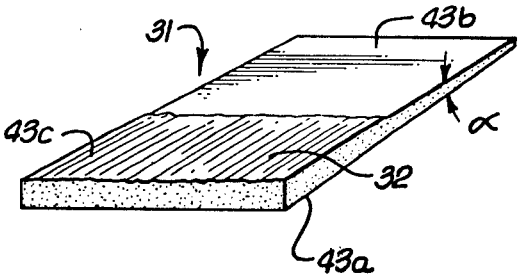
FIG. 9 is a perspective showing of the product shake.

In the drawings, an aqueous admixture is formed at 10 by combining Portland cement 11, perlite 12 (volcanic glass powder), an aqueous feed stream 13 of glass fiber 14 and cellulose 15 (such as cardboard), and a slaked lime feed stream 16. As will appear, the glass fiber and cellulose may be preliminarily blended with water 19 and 17, and the slaked lime feed may be preliminarily formed at 18 by combining quick lime 20, water 21 and tallow 22. Further, an aqueous feed stream 23 may be added to the mix at 10, stream 23 consisting of an accelerator 24 pre-blended at 25 with water 26. Finally, a small amount of Darex may be added at 27 to the mix 10, with colorant addition at 70. Roofing or siding slabs are formed from the mix as indicated, for example, by the molding step 29, and the slabs are cured as indicated at 30 to produce the product at 31. As previously brought out, the product is characterized as relatively lightweight, fireproof, inexpensive, waterproof, resilient enough to be sawable and nailable and highly thermally insulative. In particular, the mix is unusually well adapted to molding and curing in the form of shingles such as roof "shakes" having decorative undulations as seen at 32 in FIG. 9.

More particularly, best results are achieved when the constituents of the admixture at 10 are present in the following relative amounts:

a. Between 180 and 195 pounds of Portland cement
b. Between 72 and 90 pounds of Perlite
c. Between 4 and 8 ounces of Darex
d. Between 38 and 46 gallons of feed stream 13
e. Between 7 and 9 gallons of feed stream 16
f. Between 0.6 and 1 gallon of feed stream 23.

Portland cement is used to provide fireproofing, and Perlite makes the product lightweight and permits sawing and nailing as well as enhancing waterproofing.

One example of the foregoing is as follows: combine 44 gallons of feed stream 13, ¾ gallons of feed stream 23, 4 ounces of Darex, and a selected colorant, if desired, and mix for 1 minute. Next add 8 gallons of feed stream 16 and 188 pounds of Portland cement to the admixture and mix for 2 minutes. Finally, add 84 pounds of Perlite (Redco Inc type 27) to the admixture and mix for four minutes. The resultant admixture is then ready to be processed as at 29 and 30 for formation of the product. Darex, a product of W.P. Grace Co., consists of an air entraining agent.

Referring to the blending step 17, for best results and in terms of relative amounts between 40 and 48 pounds of scrap cardboard is combined with between 2 and 4 pounds of glass fiber (the glass and wood fibers add strength to the product) and between 350 and 375 gallons of water, for blending to produce a homogeneous pulp providing feed stream 13. In the slaking process designated at 18, for best results and in terms of relative amounts, between 45 and 55 pounds of quick lime is combined with between 25 and 30 gallons of water to react exothermically due to rapid hydration. Between 1.5 and 2.5 gallons of tallow is then added and blended in the hot mix (for waterproofing of the product) and to produce feed stream 16. Finally, in the mixing process designated at 25, between 3 and 5 pounds of accelerator powder is dissolved in between 1 and 3 gallons of hot water to produce feed stream 23. One unusually advantageous accelerator (which tends to cause the product to set up rapidly and assists in the waterproofing) consists principally of calcium chloride, calcium nitrate and potassium chloride, and has the following approximate composition, on a relative weight basis:

$CuCl_2$ — 1.3%
KCl — 6.0%
$CaCl_2$ — 50.1%
$Cl_2(SO_4)_3$ — 2.7%
$Ca(NO_3)_2$ — 15.9%
Other (water and impurities) — balance One example of the foregoing is as follows: 4 pounds of accelerator powder, as for example Berylex compound (a product of Berylex National Sales division of Harry Warde and Co., Kansas City, Missouri) is dissolved in 2 gallons of hot water to produce stream 23.

A typical mix at 10 has the following weight percent composition:

| Ingredient | Weight Percentage | Range |
|---|---|---|
| Water | 57.91 | 55 to 60 |
| Waste Cardboard (organic) | .75 | .50 to 1.0 |
| Fiberglass | .03 | 0 to .1 |
| Berylex | .20 | .20 to .50 |
| Lime | 2.2 | 2.0 to 3.0 |
| Tallow (organic) | .52 | .4 to 1.0 |
| Darex | .03 | .02 to .04 |
| Color | 1.1 | 0 to 2.0 |
| Cement | 25.66 | 20 to 30 |
| Perlite | 11.6 | 10 to 15 |

Figures 1, 2:
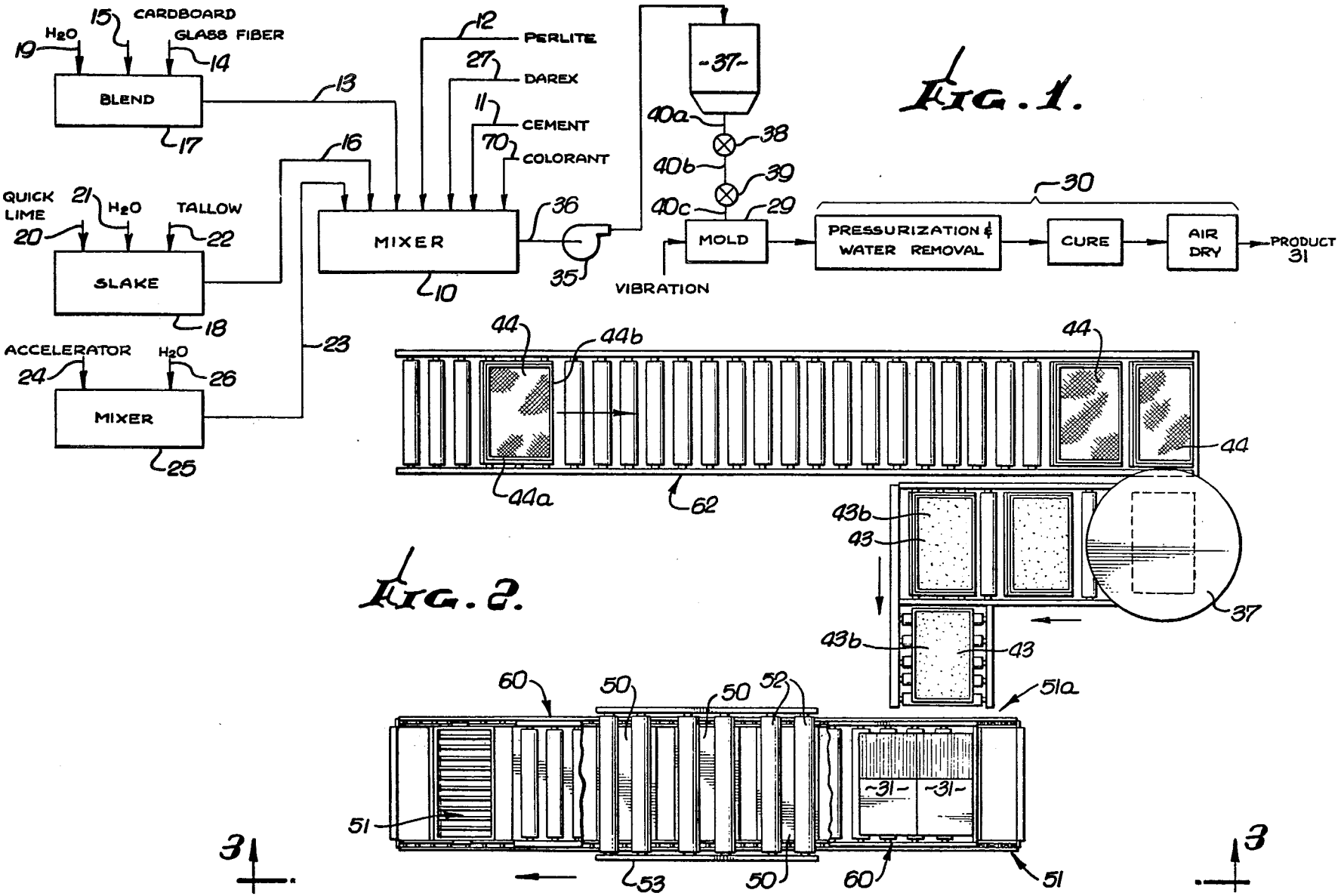
FIG. 1 is a flow diagram.
FIG. 2 is a plan view of pressurization and water removal apparatus.

Referring again to the FIG. 1, 35 designates a pump whose intake is connected to the outlet 36 of mixer 10, and whose outlet delivers the mix to a hopper 37. From the latter, controlled amounts of the mix are gravity fed to mold 29 as via a lock defined by upper and lower valves 38 and 39 connected in the delivery line 40 defined by stretches **40*a*, 40*b* and 40*c***.

Figures 3, 4, 5, 7:
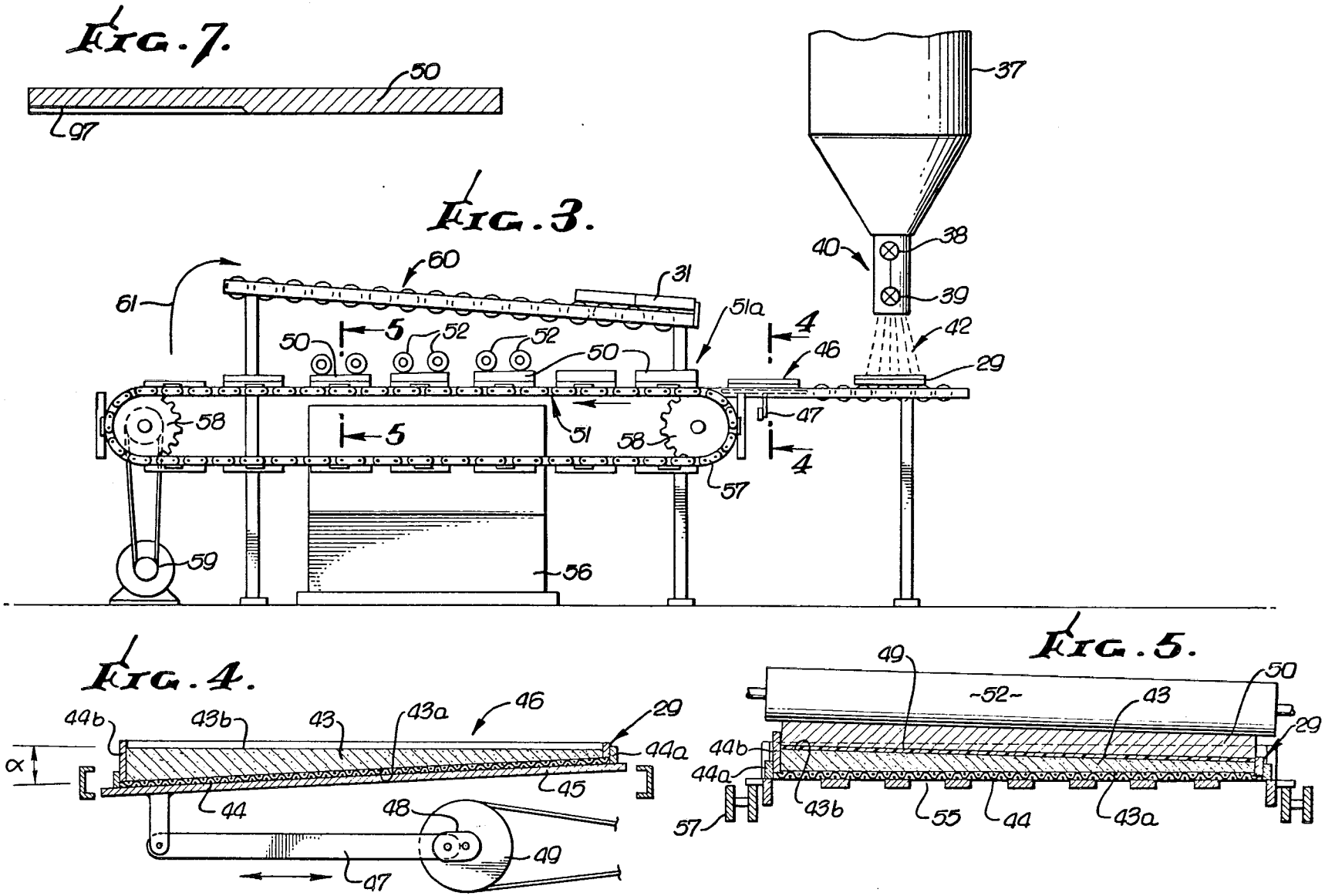
FIG. 3 is a side elevation showing the FIG. 2 apparatus.
FIG. 4 is an enlarged sectional elevation taken on lines 4—4 of FIG. 3.
FIG. 5 is an enlarged sectional elevation taken on lines 5—5 of FIG. 3.
FIG. 7 is a section taken in elevation on lines 7—7 of FIG. 6.
Figure 6:
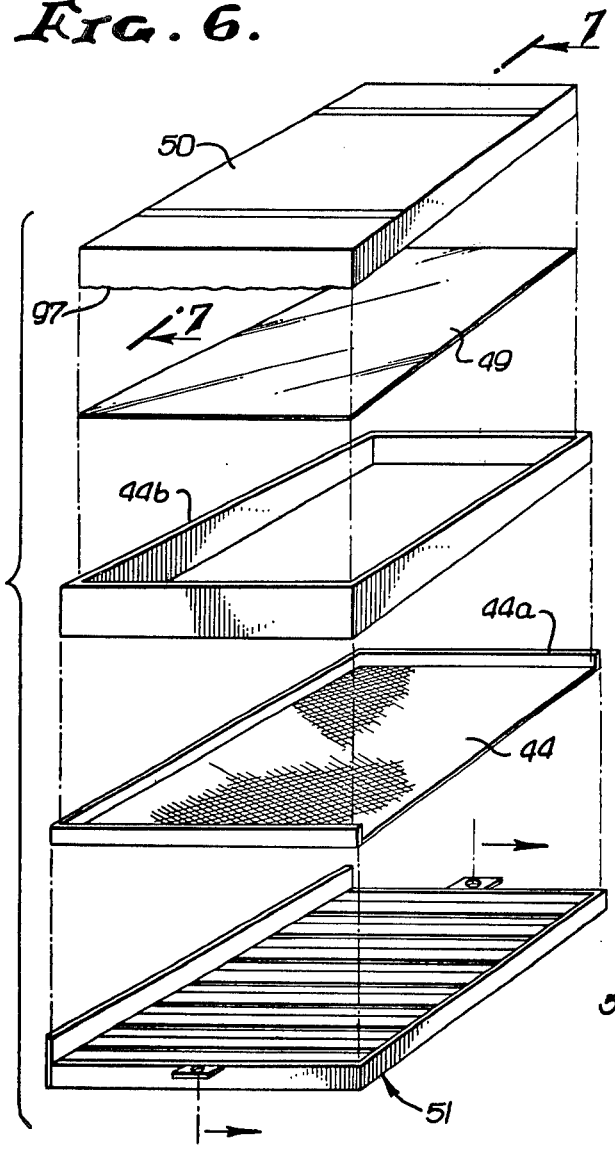
FIG. 6 is an exploded perspective showing of shake molding components, as used during curing.

Extending the description to FIGS. 3, 4 and 6 the mix is delivered at 42 into mold 29, where it assumes slab form 43 and is supported on a flat screen 44, which is inclined a few degrees from horizontal, as shown. The screen is in turn supported by inclined plate 45. Further, a rectangular frame **44*b* supported on plate 45 via screen 44 fits within screen frame 44*a*** and confines the periphery of the slab to have rectangular shape.

Next, the above assembly is transferred to a station 46 and subjected to generally horizontal and rapid vibration. For this purpose, the plate 45 may be connected by link 47 to a small crank 48 rotated by a driven rotor 49. For example, the vibration amplitude may be about ⅜ inch and frequency about 300 cycles per minute. As a result, the top surface of the uncured material defining the slab 43 assumes a horizontal level, while the overall slab itself is tapered. As seen in FIG. 4, the vibration direction indicated by the arrows below link 47 is in the slab taper direction. Note that plate 45 may support the screen 44 and the underside **43*a* of the slab at an angle $\alpha$ from horizontal, during such vibration, to form the slab with product shake wedge angularity as also appears in FIG. 9**.

Thereafter the assembly including screen 44 and 29 is transferred (as at **51*a* in FIG. 2) onto a conveyor 51, and a thin separator sheet 49 (as for example a plastic film) is placed over the top surface 43*b* of the material 43. A rectangular mold and pressure plate 50 is placed over that sheet and fitted in the frame 44b. Upon movement of the conveyor 51 to the left in FIGS. 2 and 3, the plate 50 is successively increasingly pressurized by a series of angled compression rollers 52 which may be interconnected as at 53. As a result, the mold plate 50 transmits increasing pressure transferred through the film 49 to the slab 43, for squeezing water from the material, in order to aid in curing of the latter. The paper pulp fibers act to retain the cement in the product during such pressing. Also, an irregularly striated surface may be formed on the material as at 43*c* in FIG. 9, the mold plate having a correspondingly striated surface 97** facing the slab.

Figure 8:
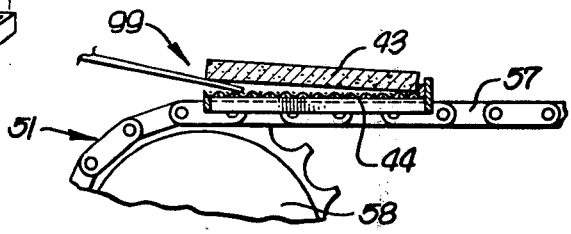
FIG. 8 is an enlarged elevation showing shake removal from the FIGS. 2 and 3 apparatus.

The conveyor itself may have drain passages 55 formed therein, as seen in FIG. 5, and water removed from the material may be collected in a trough indicated at 56 in FIG. 3. Note that plate 45 is not present in FIG. 5, and that rollers 52 are inclined from horizontal. Endless conveyor chains are seen at 57, with sprockets 58 and drive 59. Following completion of such pressurization, the mold plates are removed and placed on an inclined return conveyor 60, such transfer of the plates being indicated by arrow 61 in FIG. 3. The frame **44*b* is removed from the product slab 43, and the latter may be scooped off the screen 44 as indicated at 99 in FIG. 8. The use of a 20 mesh, 0.016 inch screen allows the product to be easily removed, intact, and without locking. The screen 44 (and associated frame 44*a* together with the frame 44*b* may be placed on a return conveyor 62 seen in FIG. 2**, for transfer and re-use in the manner previously described.

Figure 10:
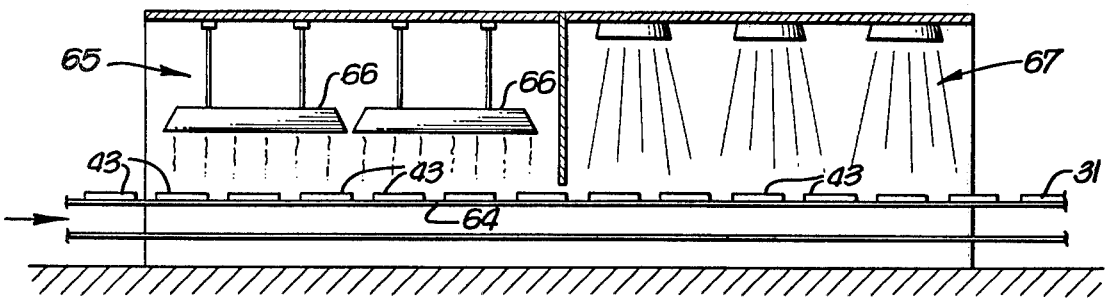
FIG. 10 is a section taken in elevation through product curing apparatus.

Finally, the slab or wedge 43, after removal of the separator sheet 49, may be placed on a support 64 in oven 65 seen in FIG. 10, and subjected to heat radiation from lamps 66, after which the shakes are air dried in chamber 67 and heated to complete the cure. As will be clear, the apparatus is especially well adapted to forming cementitious shakes on a production line basis.

Figures 11, 12, 20, 21:
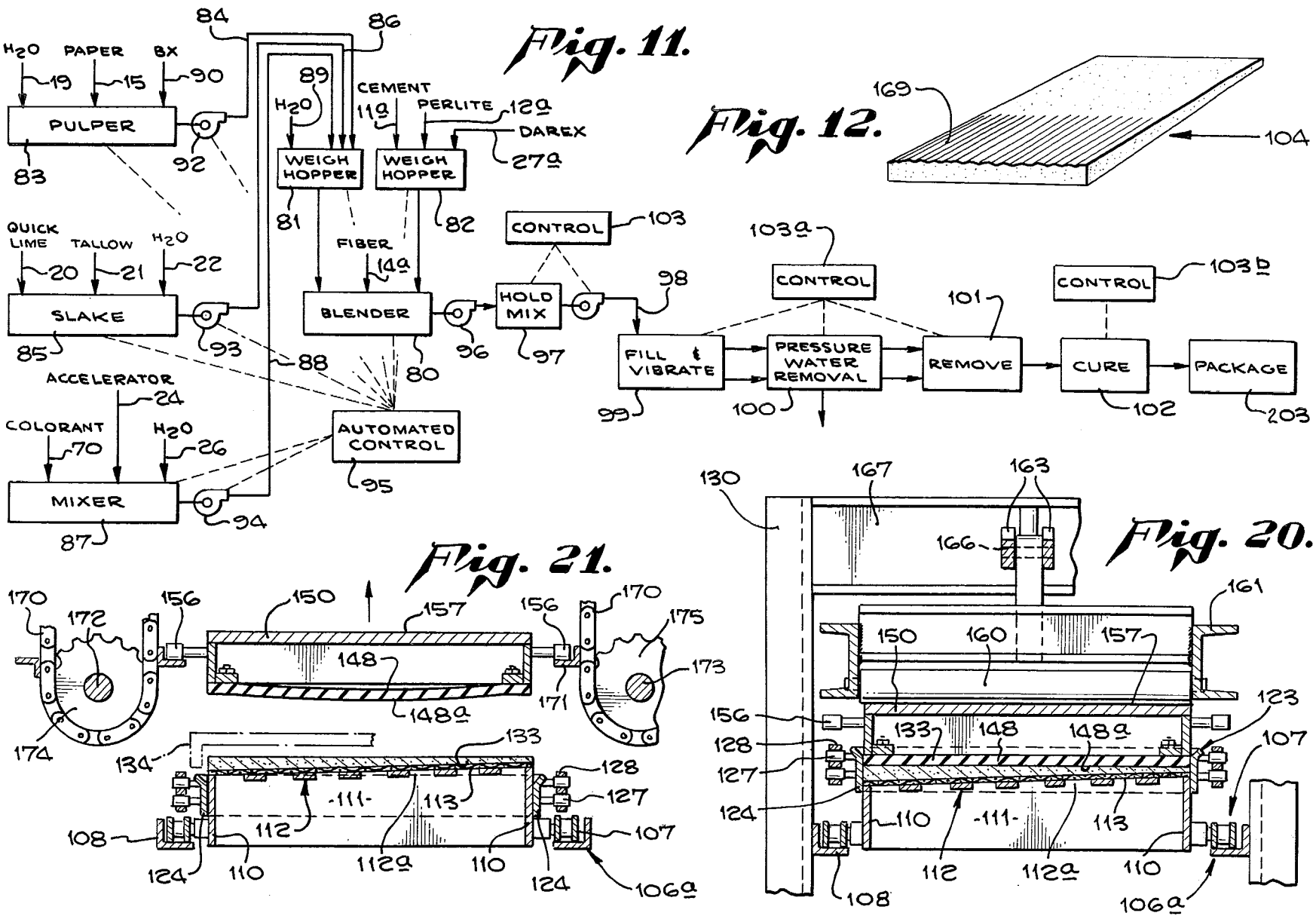
FIG. 11 is a flow diagram similar to FIG. 1.
FIG. 12 is a view of a product shingle or shake, like FIG. 9.
FIG. 20 is a vertical section on lines 20—20 of FIG. 18.
FIG. 21 is a vertical section on lines 21—21 of FIG. 19.
Figure 13:
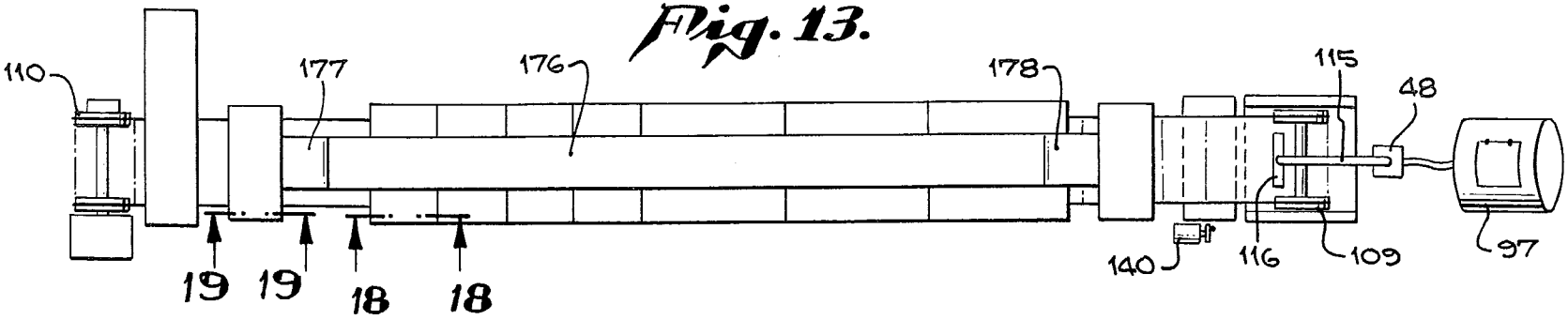
FIG. 13 is a top plan view of apparatus to produce shakes on a continuous basis.

Referring now to FIG. 11, a modified process is shown to include a blender 80 fed by two weigh hoppers 81 and 82 for wet and dry materials, respectively. Hopper 81 receives input of pulp via blender or pulper 83 and line 84, slaked lime via slaker tank 85 and line 86, colorant via mixer 87 and line 88, and water at 89.

The elements 83, and 85 may correspond to elements 17 and 18 described above, with inputs 19, 15, 14, 20–21, and 22 remaining the same; however, colorant is added at 70 to mixer 87, Berylex added at 90 to pulper 83, and fiber added at 14*a* to blender 80. Cement and perlite may be fed at 11*a* and 12*a* to the hopper 82, along with Darex at 27*a*. The ultimate composition in the blender may be the same as described above as respects the admixture at 10. Automatic controls for the elements and pumps 92–94 in lines 84, 86 and 88 are designated at 95.

The blender 80 incorporates counter-rotating elements which assure that the frazile Perlite is not broken down, destructively. Pump 96 delivers the blended mix to a holding agitator 97 near the shingle or slab producing machine. The subsequent steps of the process include delivery of slurry at 98 to fill mold cavity which is then vibrated (indicated at 99); pressurization of the slurry in the cavity and removal of excess water (designated at 100); removal of the formed slab or shingle at 101; subsequent curing at 102; and packaging at 203. Controls are indicated at 103, 103*a* and 103*b*. A product shingle appears at 104, FIG. 12, and is the same as in FIG. 9.

Figure 14:
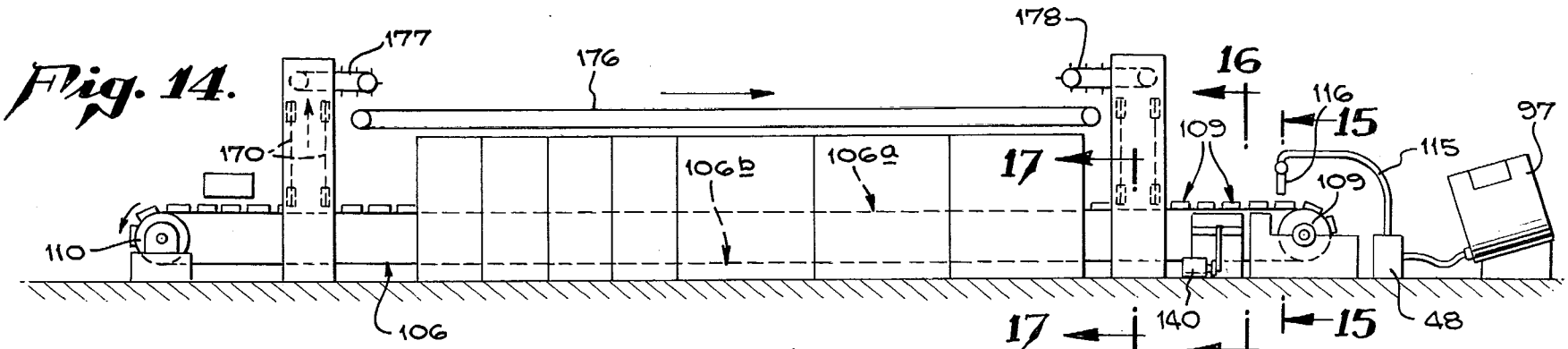
FIG. 14 is a side elevation of the FIG. 13 apparatus.
Figure 17:
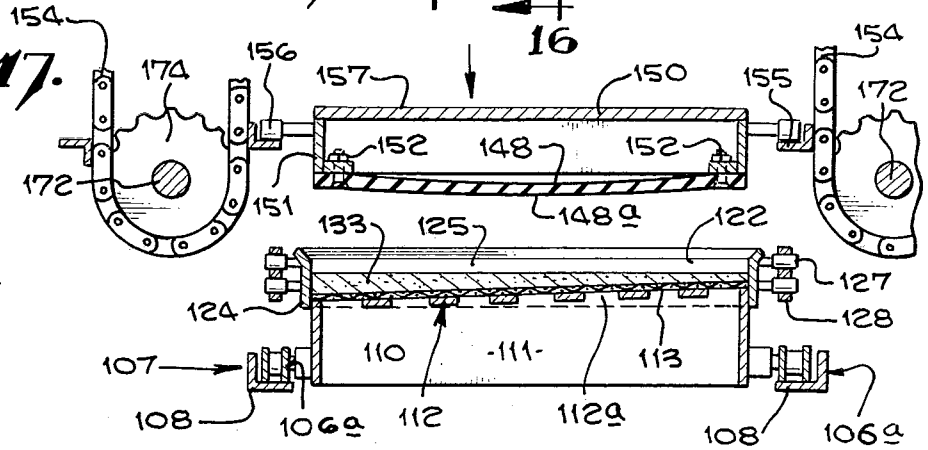
FIG. 17 is an enlarged vertical section on lines 17—17 of FIG. 14.
Figure 15:
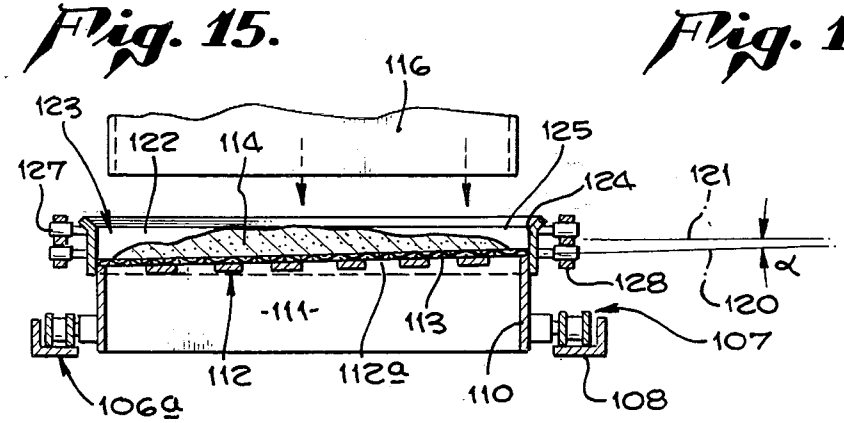
FIG. 15 is an enlarged vertical section on lines 15—15 of FIG. 14.

Referring now to FIGS. 13–21, the illustrated apparatus include a continuous conveyor, 106, having upper and lower longitudinal stretches 106*a* and 106*b*. The conveyor may include laterally spaced chains 107 trained about sprockets 109 and 110, the upper stretches of the chains riding on guide rails 108. The chains carry support means in the form of a longitudinal sequence of rectangular box like supports 109 having vertical side walls 110 and vertical end walls 111. The support means also typically includes, for each support 109 a transverse plate 112 containing vertical through openings or perforations 112a, and a screen 113 directly overlying the plate. The plate 112 is attached to the walls 110 and 111, and the plate and screen both extend laterally at a shallow angle $\alpha$ from horizontal, so that the screen upper surface extends at that angle to receive delivery of slurry 114 thereon as seen in FIG. 15. A delivery duct 115 from the pump 48 delivers slurry to a longitudinally narrow and laterally wide spout 116 which progressively feeds slurry to the screen along the length thereof as the conveyor travels the support means longitudinally forwardly, as is also clear from FIG. 14. Suitable controls cut-off slurry delivery at intervals corresponding to the gaps between passage of successive support screens beneath the spout. The plane of the screen and horizontal are indicated at 120 and 121 in FIG. 15, angle $\alpha$ being defined therebetween.

The apparatus also includes a box-like frame 123 carried on the conveyor and bounding a zone 122 directly above the support screen, so as to bound the slurry 114. In the drawings, the frame 123 includes upright side walls 124 and end walls 125 having telescopic interfit with the walls 110 and 111 of the support means. Means is also provided for displacing the frame vertically relative to the slurry support means in response to forward movement of the conveyor and frame, thereby to free the formed slurry slab or shingle for lateral removal off the support screen. In this regard FIGS. 18–21 show the provision of laterally projecting cams or cam surfaces 127 on the frame received between vertically spaced fixed guides or guide surfaces 128 extending in the path of forward movement of the cams. Guides 128 are carried in fixed support structure 130, as are the rails 108. At the sections of FIGS. 15, 16, 17 and 20, and in FIG. 18, the guides 128 hold the frame in position about zone 122, whereas in FIG. 19 the guides 128 are inclined forwardly and downwardly as at 128*a* (see arrow 131 indicating the forward direction of movement of the conveyor upper stretch). Accordingly, the frame is displaced downwardly to FIG. 21 position relative to the formed shingle or slab 133, to free it for laterally rightward sliding displacement off the screen 113, as by pull-off tool 134.

Figure 16:
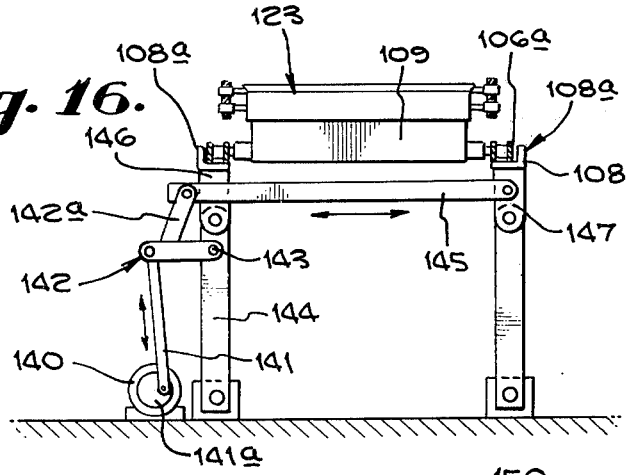
FIG. 16 is an enlarged vertical section on lines 16—16 of FIG. 14.
Figure 19:
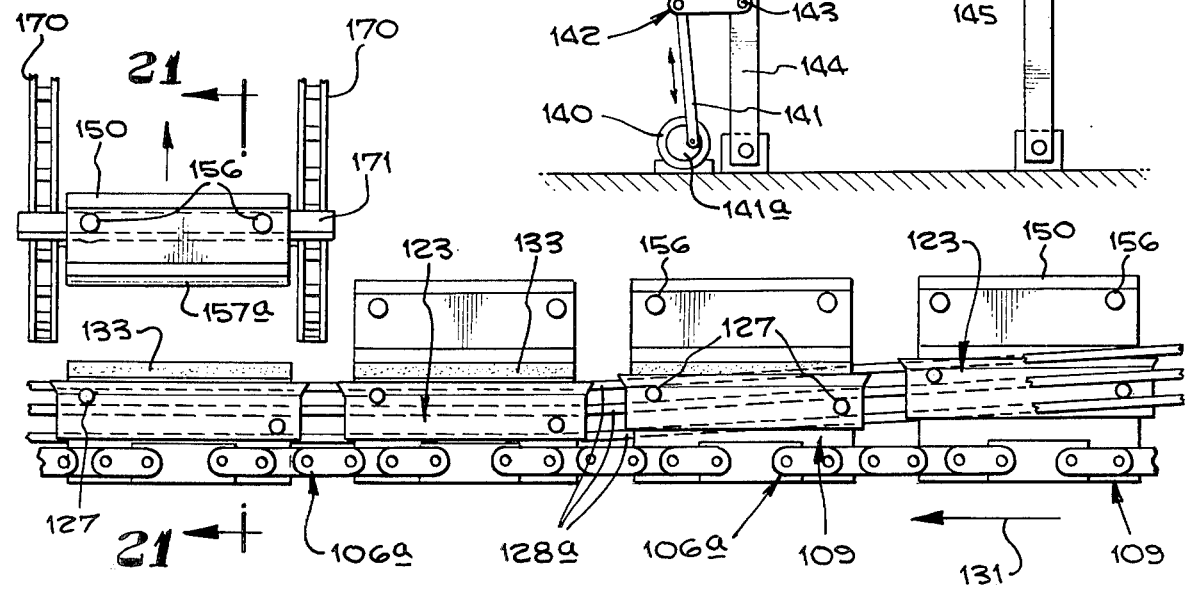
FIG. 19 is an enlarged side elevation on lines 19—19 of FIG. 13.

In accordance with an important aspect of the invention, means is provided for locally transmitting vibration to the conveyor upper stretch 106*a* to laterally vibrate that stretch between walls 108*a* of rails 108, as the latter are rapidly vibrated laterally back and forth. Accordingly, the support means including support 109, plate 112 and screen 113, along with the frame 123, along with the frame 123, are vibrated laterally back and forth, without requiring removal of the support means off the conveyor, for aiding rapid and efficient distribution of the slurry throughout zone 122, and in a lateral direction, so that the top surface of the slurry becomes approximately horizontal and the bottom surface extends fully over the screen within the frame, and at a taper angle $\alpha$ from the slurry top surface, as previously described. FIG. 16 further shows one such vibration producing means as incorporating a motor 140, an upright link 141 having an eccentric connection to a disc 141*a* driven by the motor so that the link moves up and down, a bell crank 142 pivoted at 143 to fixed upright support leg 144, a link 145 displaced laterally by the crank arm 142*a*, and laterally swingable supports 146 and 147 connected to link 145 and supporting the rails 108. Other type lateral vibration may be employed.

A further aspect of the invention concerns the provision of pressure application means for applying downward pressure to the slurry vibrated into shingle shape, for squeezing excess water from same. Such means may, with unusual advantage include a transversely extending, vertically flexible pusher, as for example is exemplified by the elastomeric slab or plate 148 seen in FIG. 17 to have a downwardly convex lower surface 148*a* spaced directly above the slurry zone. A carrier for the pusher may comprise a metallic plate 150 to which the pusher is peripherally attached as via carrier skirt 151 and fasteners 152. Means to lower the carrier to drop the pusher onto the slurry includes endless conveyors 154 extending vertically in FIG. 17, and having ledges 155 landing the lateral projections 156 integral with the carrier. As the conveyors and ledges move downwardly, the carrier and pusher are lowered to FIG. 20 position, the pusher 148 fitting within the frame 123, and the ledges 155 dropping away from the projections 156.

Figure 18:
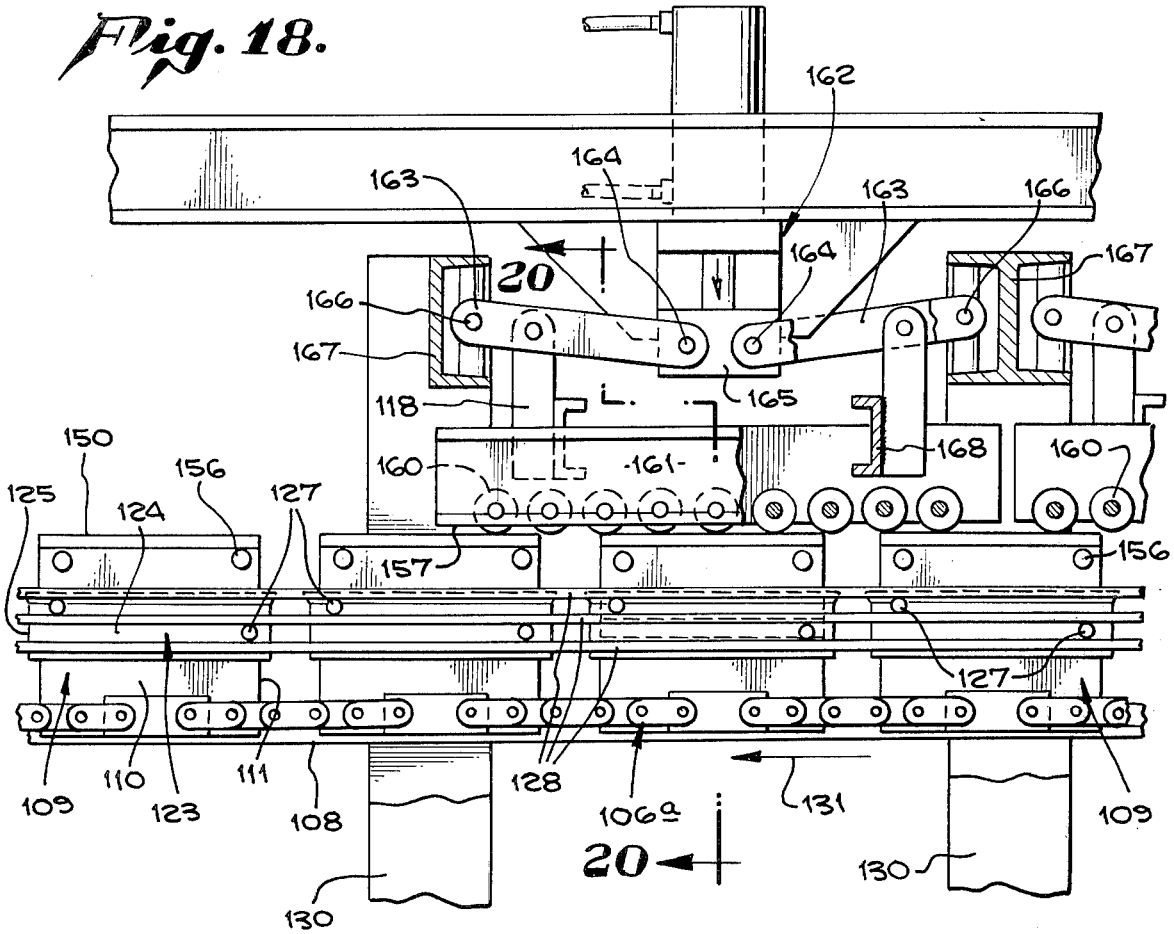
FIG. 18 is an enlarged side elevation on lines 18—18 of FIG. 13.

The carrier plate 150 presents a pressure receiving upper surface 157, and FIGS. 18 and 20 show pressure structure engaging that surface to transmit downward pressure thereto acting to urge the pusher downwardly against the slurry in response to forward movement of the conveyor upper stretch which conveys the carrier and pusher 148 forwardly within frame 123. Such pressure structure advantageously includes rollers 160 rotatable about lateral axes and carried by a movable pressure frame 161 to which downward load is applied via actuator 162, links 163 pivoted at 164 to the actuator plunger 165 and pivoted at 166 to fixed frame 167, and structure 168 connecting the links to frame 161.

Rollers 161 urge the successive carriers downwardly, as is clear from FIG. 18. The hard rubber pusher 148 is slightly oversized in relation to the carrier and is connected to the latter so as to bulge downwardly, the lower face 148*a* having the imprint of lateral wood grain to be imparted to the shingle, as at 169 in FIG. 12, during pressure application to the slurry. Accordingly, as the pusher is ultimately relatively lifted, it progressively laterally peels away from the slurry so that the grain imprint is not disturbed. This procedure allows for very rapid, simple and accurate shingle formation.

Finally, means is provided to elevate the carrier and pusher relative to the support means for the formed shingle, in order to peel the pusher progressively off the slurry subsequent to downward application of pressure to the carrier, as described. Such means may include the endless conveyors 170 in FIG. 21 with ledges 171 lifting the projections upwardly. Drives for the conveyors 154 and 170 appear at 172 and 173, sprockets 174 and 175 being attached to same. The carriers and pushers are returned as via an upper conveyor 176, shown in FIG. 14, to the conveyors 154, auxiliary conveyors 177 and 178 aiding the transfer between conveyors 170 and 176, and conveyors 176 and 154.

In FIGS. 14 and 16, lateral vibration is confined to only a portion of the upper stretch 106*a* traveling between two pairs of laterally swingable supports 146 and 147.

I claim:

1. Apparatus for making a cementitious product slab useful in construction, that comprises, a. a continuous conveyor having a stretch movable in a longitudinal direction, there being fixed support structure supporting said conveyor, b. support means carried by the conveyor stretch and having an upper surface which extends laterally at a shallow angle taper $\alpha$ form horizontal, c. a frame carried on the conveyor stretch and bounding a zone directly above said support means, said zone adapted to receive a flowable aqueous cementitious slurry, said zone being upwardly open to accommodate downward application of pressure transmitted to said slurry, and d. vibration means for locally transmitting vibration to said stretch to laterally vibrate the stretch, support means and frame for aiding distribution of the slurry throughout said zone and primarily in a lateral direction so that the top surface of the slurry becomes horizontal and the bottom surface of the slurry extends at the taper angle $\alpha$ from the slurry top surface, the support structure including longitudinal guide means for the stretch, and said vibration means operatively connected with said guide means to locally vibrate same laterally, thereby to vibrate the conveyor stretch and support means laterally, as aforesaid.

2. The apparatus of claim 1 wherein said frame has vertical telescopic interfit with said support means, and including means for displacing the frame vertically relative to the support means in response to forward motion of the conveyor and frame, thereby to free the slurry for lateral removal off the support means, said means for displacing the frame vertically including cam surfaces on the frame and fixed guide surfaces in the path of forward movement of said cam surfaces.

3. The apparatus of claim 1 including pressure application means operatively associated with said conveyor for applying said downward pressure to the slurry, said means including a vertically resiliently flexible pusher having a downwardly convex lower surface spaced directly and unobstructedly above said zone and adapted to be relatively lowered into direct progressive contact with the slurry therein, and to be relatively raised so as to progressively release from contact with said slurry.

4. The apparatus of claim 3 wherein said pressure application means includes a carrier for said pusher presenting a pressure receiving surface, and pressure structure extending over said pressure receiving surface and engageable with said pressure receiving surface to transmit pressure thereto acting to urge said pusher downwardly against the slurry in response to forward movement of the conveyor stretch, support means, slurry, carrier and pusher relative to the pressure structure.

5. The apparatus of claim 4 wherein said pusher comprises an elastomeric plate which extends generally horizontally and has local attachment to said carrier, so that the carrier is spaced above the pusher and the pusher may deflect upwardly relative to the carrier.

6. The apparatus of claim 5 including upright means near the conveyor to lower the carrier and pusher and to drop same to bring the pusher into contact with the slurry prior to engagement of said pressure structure with said carrier pressure receiving surface.

7. The apparatus of claim 1 wherein said support means includes a screen extending directly below said zone and defining said upper surface extending at said taper angle $\alpha$, and a perforated plate extending in underlying relation to said screen.

8. The apparatus of claim 6 including means near the conveyor to elevate the carrier and pusher relative to the support means to peel the pusher progressively off the slurry subsequent to said application of pressure to the carrier.

9. Apparatus for making a cementitious product slab useful in construction, that comprises, a. a continuous conveyor having a stretch movable in a longitudinal direction, b. support means carried by the conveyor stretch and having an upper surface which extends laterally at a shallow taper angle $\alpha$ from horizontal, c. a frame carried on the conveyor and bounding a zone directly above said support means, said zone adapted to receive a flowable aqueous cementitious slurry, said zone being upwardly open to accommodate downward application of pressure transmitted to said slurry, d. means operatively associated with said conveyor for locally transmitting vibration to said stretch to laterally vibrate the stretch, support means and frame for aiding distribution of the slurry throughout said zone and in a lateral direction so that the top surface of the slurry becomes horizontal and the bottom surface of the slurry extends at the taper angle $\alpha$ from the slurry top surface, and e. pressure application means for applying said downward pressure to the slurry, said means including a vertically resiliently flexible pusher having a downwardly convex lower surface spaced directly and unobstructedly above said zone and adapted to be relatively lowered into direct progressive contact with the slurry therein, and to be relatively raised so as to progressively released from contact with said slurry, said pressure application means including a carrier for said pusher presenting a pressure receiving surface, and pressure structure extending over said pressure receiving surface and engageable with said pressure receiving surface to transmit pressure thereto acting to urge said pusher downwardly against the slurry in response to forward movement of the conveyor stretch, support means, slurry, carrier and pusher relative to the pressure structure, said pusher comprising an elastomeric plate which extends generally horizontally and has local attachment to said carrier, so that the carrier is spaced above the pusher and the pusher may deflect upwardly relative to the carrier, and including upright means near the conveyor to lower the carrier and pusher and to drop same to bring the pusher into contact with the slurry prior to engagement of said pressure structure with said carrier pressure receiving surface.

* * * * *